United States Patent [19]

Yokoi

[11] 3,960,380

[45] June 1, 1976

[54] LIGHT RAY GUN AND TARGET CHANGING PROJECTORS

[75] Inventor: Gunpei Yokoi, Kyoto, Japan

[73] Assignee: Nintendo Co., Ltd., Kyoto, Japan

[22] Filed: Jan. 27, 1975

[21] Appl. No.: 544,342

[30] Foreign Application Priority Data

| | | |
|---|---|---|
| Sept. 16, 1974 | Japan | 49-106237 |
| Dec. 1, 1974 | Japan | 49-138658 |
| Dec. 31, 1974 | Japan | 50-1752 |

[52] U.S. Cl. ..... 273/101.1; 35/25

[51] Int. Cl.[2] ..... A63F 9/02

[58] Field of Search ..... 273/101.1, 101.2, 102.2 R, 273/105.3; 35/25; 352/39

[56] References Cited

UNITED STATES PATENTS

| | | | |
|---|---|---|---|
| 2,230,149 | 1/1941 | Weddington | 273/101.1 |
| 2,406,574 | 8/1946 | Waller | 273/105.1 |
| 2,593,117 | 4/1952 | Davenport | 273/101.1 |
| 2,995,834 | 8/1961 | Rowe | 273/101.1 |
| 3,655,192 | 4/1972 | Hall | 273/101.1 |
| 3,802,099 | 4/1974 | Mell | 35/25 |

*Primary Examiner*—Richard J. Apley
*Assistant Examiner*—Marvin Siskind
*Attorney, Agent, or Firm*—Wenderoth, Lind & Ponack

[57] ABSTRACT

A rapid-firing game machine wherein a player with a light-emission gun fights a series of simulated fights with images of objects (e.g. gunmen) on a motion-picture screen. A first film on a first projector has a plurality of scenes each including one of the gunmen and a second film has the same number of scenes showing the corresponding gunmen in defeated condition, a successful firing of the player's weapon causing said second projector to be driven and brought into projecting relation with said screen while said first projector remains to be driven but not in projecting relation and an unsuccessful firing of the weapon causing said first projector to remain in projecting relation while the second projector remains to be driven for a while but not in projecting relation.

5 Claims, 18 Drawing Figures

LIGHT RAY GUN AND TARGET CHANGING PROJECTORS

SUMMARY OF THE INVENTION

This invention relates to a rapid-firing game machine of the type involving the use of a light-emission gun (pistol) wherein a player having a gun of the type described faces a motion-picture screen and fights a series of simulated fights with a plurality of images of gunmen or objects of prey as optically projected onto said screen, each successful impingement of the light beam from the player's weapon on the target area resulting in a changeover from a scene to a different scene on the screen with or without an additional display of the results of such simulated fights.

Gun-fighting simulation machines of the aforementioned type are well known and have been described in numerous patents, for example U.S. Pat. No. 2,404,653 (Electric target game), U.S. Pat. No. 2,527,326. (Indicating targets for simplated projections), U.S. Pat. No. 2,957,695 (Target projection apparatus) and U.S. Pat. No. 3,802,099 (Method and apparatus for training policemen). In U.S. Pat. No. 2,404,653, the player vies with a target of prey in a rapid-firing game and the target of prey retreats as he is defeated while it assumes an assaulting position as the player fails to hit him. U.S. Pat. No. 2,527,326 discloses an apparatus comprising a first optical projector adapted to project a scene including the target to be shot and a second projector for showing a scene including the same target in defeated condition, the player's successful shooting resulting in a changeover from the first-mentioned scene to the second-mentioned scene. U.S. Pat. No. 2,957,695 and U.S. Pat. No. 3,802,099 describe shooting simulation apparatuses involving a changeover of images upon successful shooting as in the aforementioned machine of U.S. Pat. No. 2,527,326

In the apparatus of U.S. Pat. No. 3,802,099 which is intended for the training of law enforcement officers, to project scenes each showing a decoy and a suspect, both in the wounded or dying condition, two projectors are provided in addition to the projector for projecting images of the decoy and suspect.

It is an object of this invention to provide a shooting simulation apparatus which is able to sequentially project a plurality of scenes and different scenes associated with the first-mentioned scenes from a single film for each series of the scenes.

Another object is to provide a shooting simulation machine comprising a couple of motion-picture projectors, each of which is adapted to project a series of scenes without giving an impression of discontinuity between the images projected by the two projectors.

Another yet object is to provide a shooting simulation machine of the type just mentioned, with which the player may experience a coherent, yet variegated series of experiences.

Another yet object is to provide a shooting simulation machine which is simple in construction and easy to manufacture at low cost.

These and other objects of this invention will become apparent from the following description and the accompanying drawings.

DETAILED DESCRIPTION OF THE INVENTION

This invention relates to a rapid-firing game machine comprising a shooting means including a gun, a screen, a shooting detection means having a target area on said screen, a first motion-picture projector capable of projecting images showing an object to be shot at on said screen, a second motion-picture projector capable of projecting images of the same object in an altered condition contingent upon successful shooting and a projection-changeover device adapted to switch the images on said screen from said first motion-picture projector to the images from said second motion-picture projector, characterized in that said first motion-picture projector carries a single first film provided with a plurality of scenes including objects (in the embodiment illustrated, gunmen $G_1$, $G_2$ and $G_3$) and said second motion-picture projector carries a single second film provided with a plurality of scenes including the same objects in defeated condition, said second projector being driven and brought into projecting relation with said screen upon successful shooting, while said first projector remains to be driven but not projecting the film carried thereby, while unsuccessful shooting causing said first projector to project said first film while driving the second projector but not causing it to project the second film, the object to be displayed by the second projector corresponding to the object displayed by the first projector, said gun being a light-emission gun and said shooting detection means being formed by a light-sensitive element and the detecting area of the light sensitive element being large enough to cover at least substantially the entirety of the aforementioned object.

Figure 1:
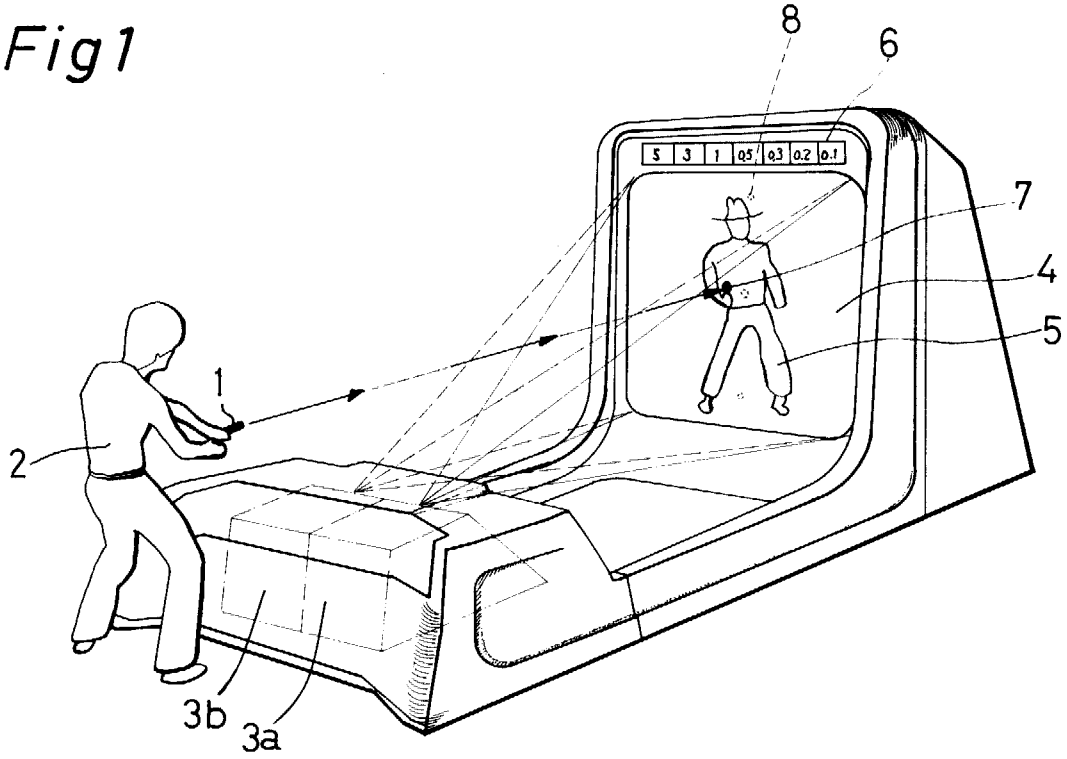
FIG. 1 is a perspective view showing a rapid-firing game machine embodying the principle of this invention.
Figure 2:
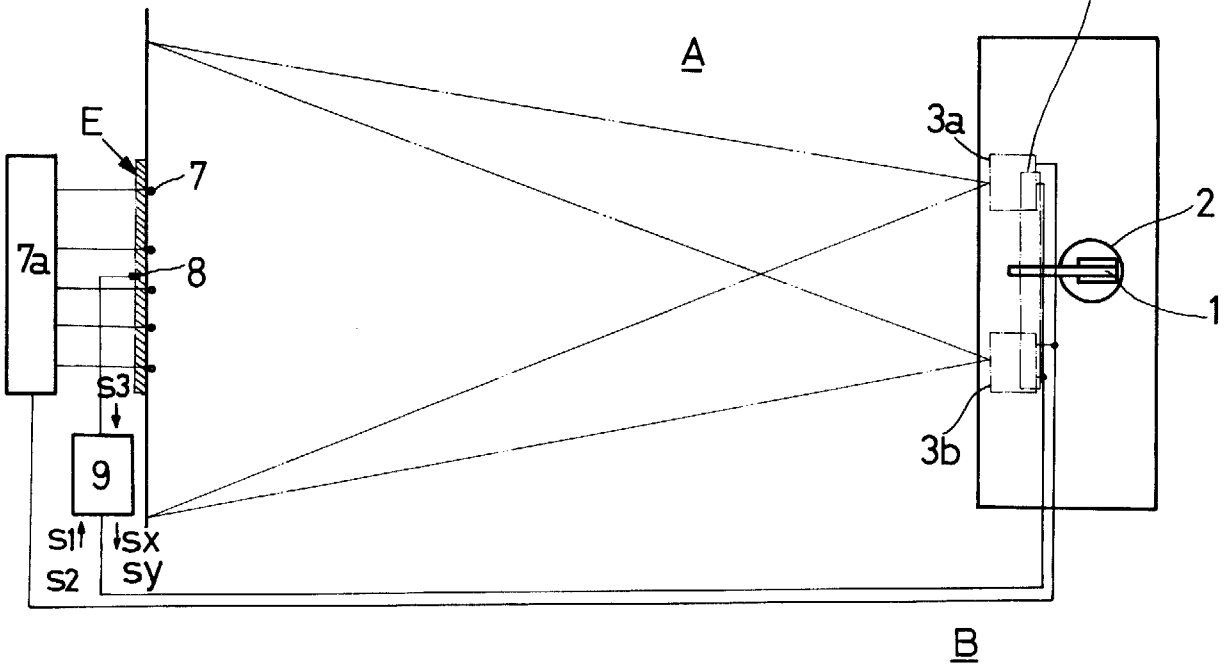
FIG. 2 is a plan view of the same machine.

Referring to FIGS. 1 and 2, a player 2 having a light-emission weapon (e.g. gun or pistol) 1 fights a simulation fight with a life-size image 5 of a gunman which is projected by a first motion-picture projector 3*a* on a screen 4. Indicated by reference numeral 6 is a time-score display device (for example, a device adapted to display the 'round' number of the game being played in yellow light and the cumulative score of hits in red light), 7 is a shooting start indicating means as displayed on said screen 4, and 8 is one or a plurality of light-sensitive elements constituting the shooting detection means disposed in mutually spaced relation on the reverse side of and adacent to said screen 4. The aforementioned shooting start indicating means 7 does not define the actural target area, although it is generally formed within the area of the screen which is responsive to the light beam from said weapon 1, but rather indicates to the player 2 that he is now allowed to fire the weapon 1. Reference numeral 3*b* indicates a second motion-picture projector adapted to project a scene showing a gunman 5 wounded or otherwise in defeated condition, that is to say a scene showing the result of the player's successful fight.

A shooting simulation apparatus A comprises a light-emission gun 1, and a light-sensitive element 8, and said light-emission gun (pistol) 1 has a light source 1*a* and a lens 1*b* built into a barrel 1*c*. The light beam H from said light-emission gun 1 is directed toward the screen 4 with a predetermined or variable angle of expansion $\alpha$, that is to say, in the form of a cone as illustrated and, therefore, the light beam H from light-emission gun 1 is incident upon said light-sensitive element 8 even when the extension of the centerline of the barrel 1*c* of light-emission gun 1 is not exactly coincidental with the axis of element 8.

Figure 3:
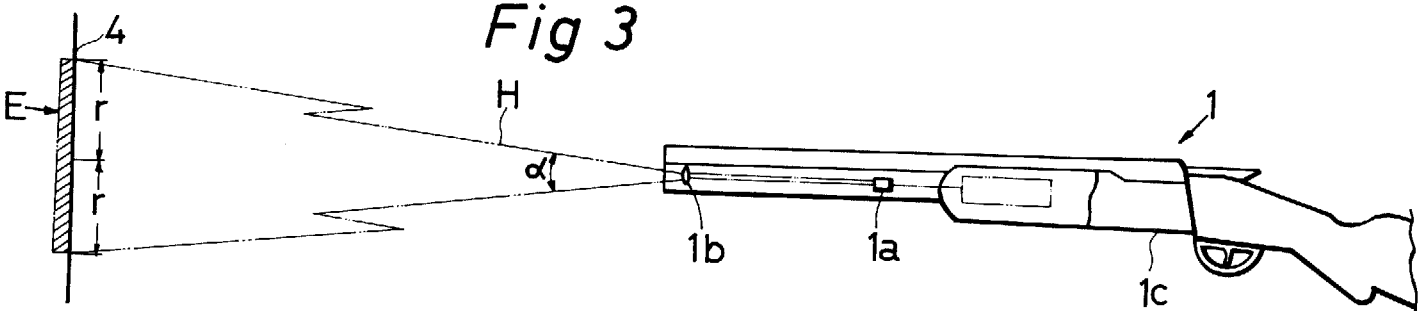
FIG. 3 is a schematic view showing the effective area of the light-emission gun to be employed.
Figure 4:
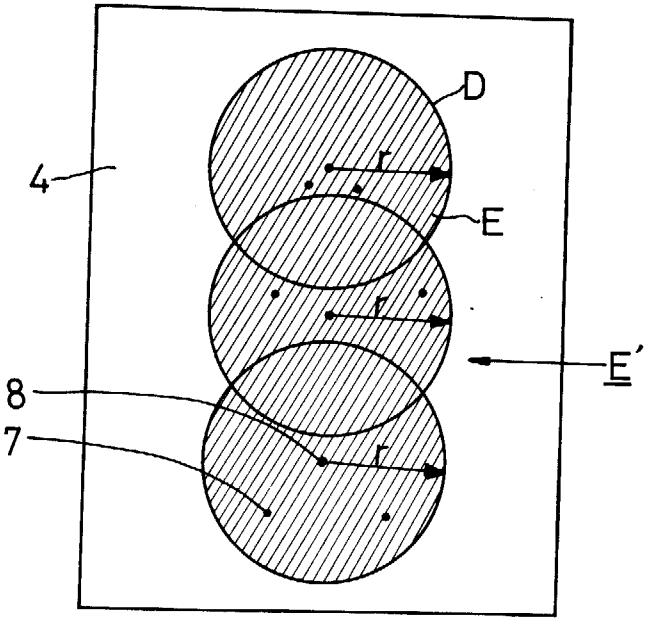
FIG. 4 is a plan view showing the effective target area.

Thus, referring to FIGS. 3, and 4 assuming that the light beam H from the light-emission gun 1 has an angle of expansion of $\alpha$, the effective sensitive area E of said light-sensitive element 8 is defined by a circle D of radius $r$ and the sensitive area E' of three light-sensitive element 8 (FIG. 4) is the composite area of three partially overlapping circles D which is large enough to cover the full length of the image of gunman 5 on the screen 4.

In the embodiment illustrated in several views of the drawings, the distance between the shooting position of the player 2 and the screen 4 is about 3 to 5 meters, the height of the screen 4 is about 2 to 2.5 meters and the height of said composite light-sensitive area E' is 1.5 to 2 meters, i.e. the height of said life-size image of gunman 5.

It should be understood that when marksmanship is not a supreme interest, as it is the case in the present apparatus which is mainly directed to the general public including younger people, such a broad range of possibility of hitting the gunman enables people of almost all ages to participate in the game. However, for players who also desire to improve their marksmanship, there are provided guns adapted to produce light beams with different angles of expansion (for example, three types of guns) so that a skilled player may employ a gun with the smallest angle of expansion and a novice or child may use a gun with the largest angle of expansion.

Alternatively, the actural range of light sensitivity may be varied by changing the intensity of incident light. This change in the intensity of incident light may be accomplished by adjusting the sensitivity of the photo-transistor used for the responsive element 8 or by adjusting the sensitivity of an electronic circuit provided at the output of photo-transistor (for example, by varying the working voltage of the transistor circuit for amplification and output control). Thus, by adjusting the sensitivity of light-sensitivity of element 8 in synchronism with the driving of the first motion-picture projector 3*a*, the probability of successful firing of the weapon 1 may be successively reduced from one of the scenes to the next scene.

The aforementioned shooting start indicating means 7 is formed in the following manner. Thus, a first film P on the first motion-picture projector is provided with an aperture in the portion thereof corresponding to each of said plurality of scenes so that the light beam from said light source in said first motion-picture projector 3*a* passes through said aperture to cause a confined area of the corresponding image of the gunman on said screen (e.g. the area substantially corresponding to his eyes, chest or abdomen) to glitter for a fraction of a second. As an alternative, a plurality of lighting devices are provided on the reverse side of said screen 4. In this instance, there is provided a shooting start indicator control device 7*a* which is driven in timed relation with the advance of said first film P in such a manner that its electronic contacts or movable contacts are sequentially short-circuited so that a selective one of said plurality of lighting devices may be acturated according to the particular scene on said first film P which is being projected at the moment to form said glaring-light signal on said screen 4. The change in position of the shooting start indicating means is to accomodate the shooting attitude of each gunman on the first film P.

Figure 5:
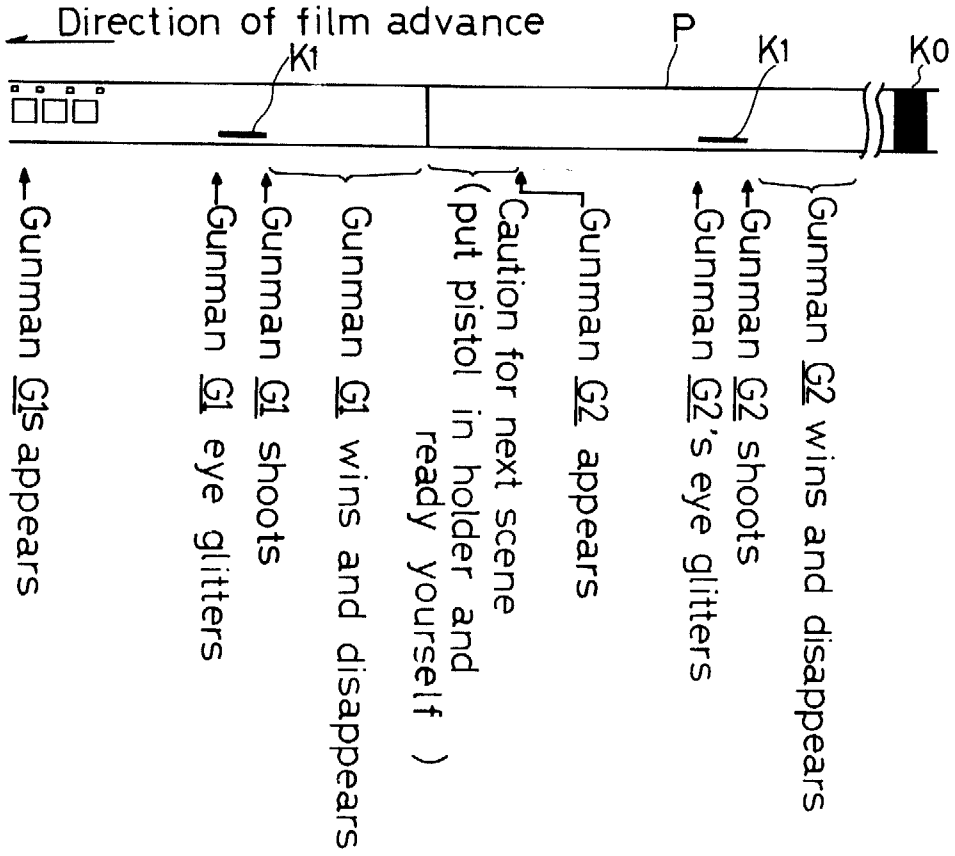
FIG. 5 is a schematic view for explaining a signal mark $K_1$ on a first motion-picture film P.
Figure 6:
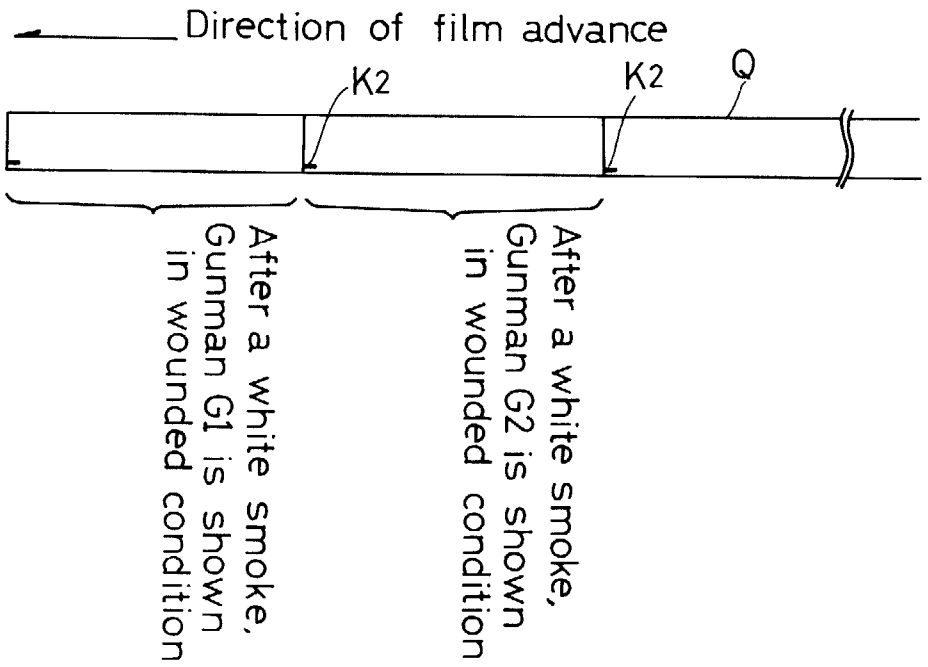
FIG. 6 is a schematic view for explaining the signal mark $K_2$ on a seconf film Q.
Figure 7:
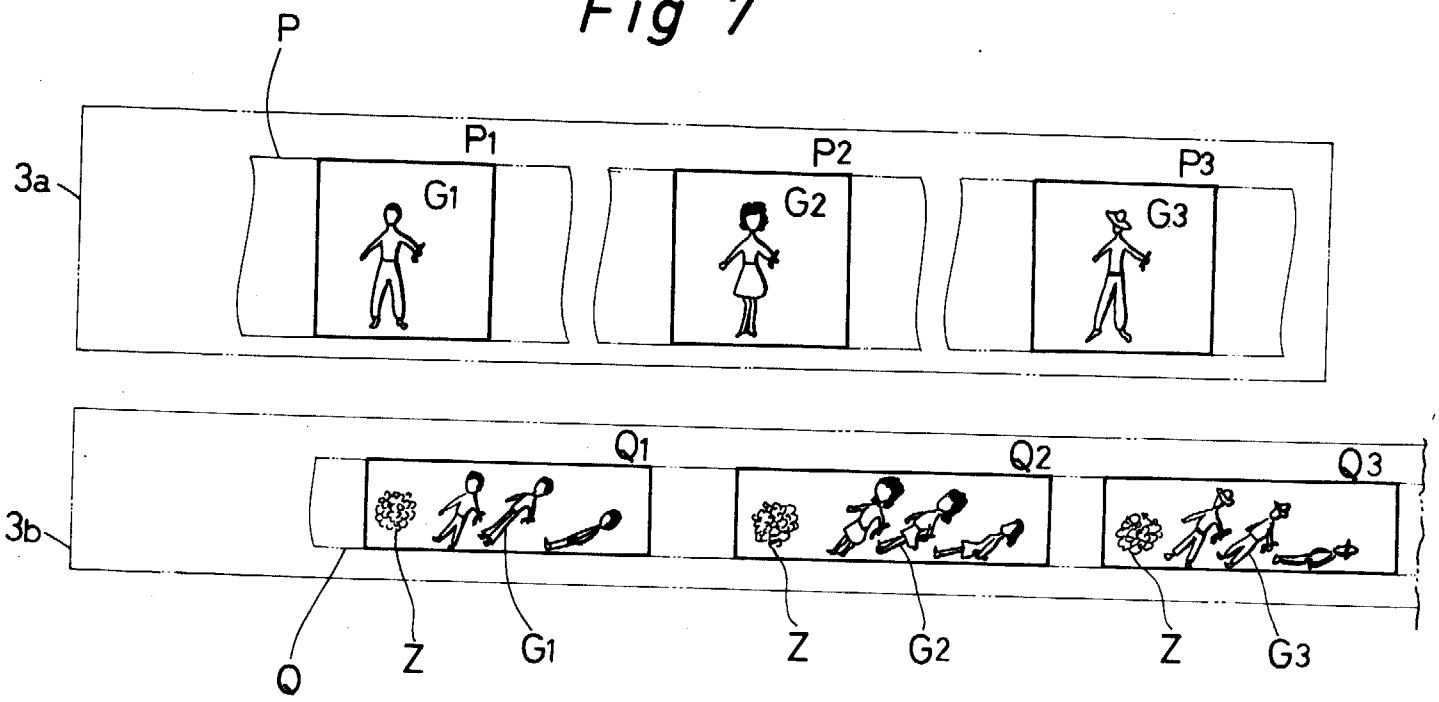
FIG. 7 is a schematic fragmentary view showing the images on films P and Q.

The scenes projected from said first film P by said first motion-picture projector, as shown in FIGS. 5 and 6, include the appearances, in challenging attitude, and subsequent disappearances, in triumphant attitude, as generally indicated at $P_1$, $P_2$, $P_3$ . . . , of gunmen $G_1$, $G_2$, $G_3$ . . . and said first film P has an aperture for producing a glaring-light target and a signal mark $K_1$ for generating an effective shooting signal $S_1$ which sets a predetermined effective shooting time for each scene. Referring to FIGS. 6 and 7, the images projected from a second film Q on said second motion-picture projector 3*b* include a plurality of scenes each comprising a leading portion showing a view-blocking device, e.g. a white smoke, and a subsequent portion showing a gunman $G_1$, $G_2$, $G_3$ . . . wounded and falling down on his knees, as well as a signal mark $K_2$ for generating a signal $S_2$ for terminating the driving and projection of said second film at or adjacent the boundary between any two adjacent scenes.

The aforementioned signal marks $K_1$ and $K_2$ of films P and Q may be optically printed in the manner known per se simultaneously when said images are printed. This type of printing is conducive to an increased useful life of the signal marks.

The screen 4 is made substantially square so that the projected gunmen may appear more imposing and threatening in their challenging attitudes. Therefore, as shown in FIG. 8, the area T of each frame (a rectangle $4 \times 3$) of the film other than the image portion is made available for printing signal marks $K_1$, $K_2$.

Figure 9:
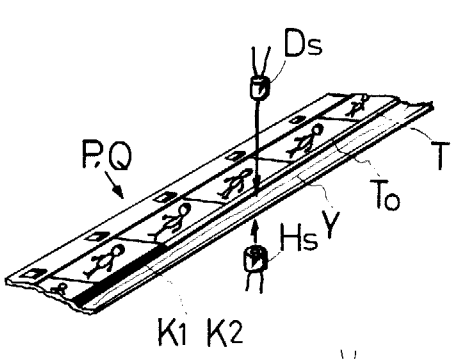
FIG. 9 is a perspective view showing a method for detecting the signal $S_1$ by signal mark $K_1$.

The presence of signal mark $K_1$ or $K_2$ is optically detected by a light-emission diode Ds and a light-receiving element Hs, which are disposed so that the film travels therebetween (FIG. 9). The aforementioned location of said signal mark $K_1$, $K_2$ in an inner area of the picture frame protects the mark from the frictional force acting on the film as the latter is advanced on the motion-picture projector.

Figure 8:
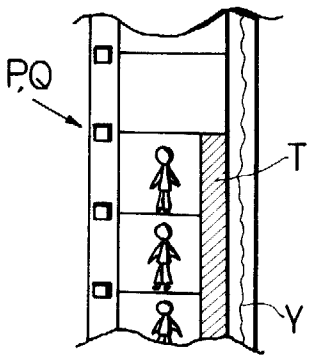
FIG. 8 is a schematic view showing the effective shooting signal $S_1$.
Figure 10:
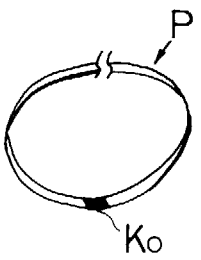
FIG. 10 is a schematic view showing the signal $S_0$.
Figure 11:
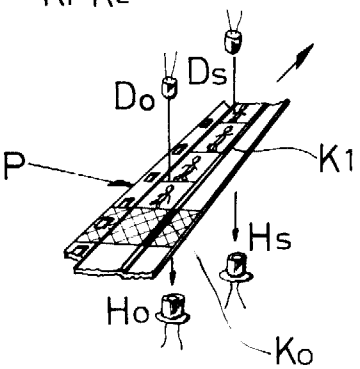
FIG. 11 is a perspective view showing a method for detecting $S_0$.

Referring to FIGS. 8 and 9, Y indicates a sound track for reproducing the sounds of gun fights. The films P and Q are each an endless film. The film P has a game-over signal mark $K_0$ for generating a game-over signal $S_0$ at the end of the last one of said series of scenes. The first film P is a color film, as may be the second film Q. Therefore, as illustrated in FIG. 10, a black patch of black-and-white film is interposed at the joint of said endless film to form said game-over signal mark $K_0$. As shown in FIG. 11, the film is caused to travel between an infra-red light-emission diode $D_0$ and an infrared light-receiving element $H_0$, whereby said game-over signal mark $K_0$ is detected. Since the signal marks $K_1$ and $K_2$ printed on 16-mm color films are black or color film, that is to say a black made by synthesis of three primary colors, they do not transmit light in the visible region of the spectrum but selectively transmit infrared light (usually about 900 m$\mu$). On the other hand, said black patch of black-and-white film shuts out both visible and infrared rays. Thus, said first film P is caused to travel through a detection zone comprising a visible light-emission diode Ds, an infrared light-emission diode $D_0$ and photo-receiving elements Hs and $H_0$ (FIG. 11).

Figure 12:
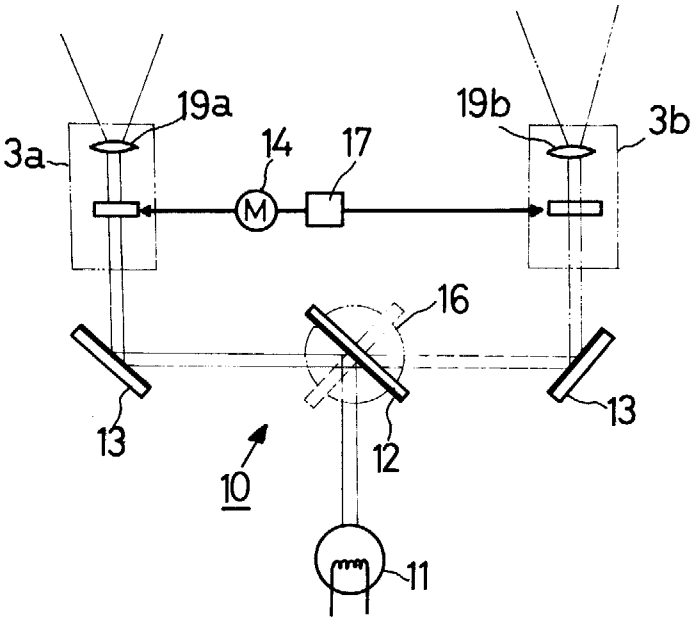
FIG. 12 is a schematic view showing a projection-changeover device.

The projection-change control device B comprises a control circuit 9 and a projection-change over means 10 which dictates the projection or non-projection of the films. As schematically shown in FIG. 12, the projection-switchover means 10 is so designed that the light beam from a light source 11, which may for example be a halogen lamp, is selectively reflected by a mirror 12 rotatably mounted on a stationary shaft to illuminate said first film P on said first motion-picture projector 3*a* or said second film Q on said second motion-picture projector 3*b* as said mirror 12 is inclined in such a manner that the image of said first film P or second film Q is projected onto screen 4 through a projection lens 19*a* or 19*b*.

The output of an electric motor 14 is transmitted to said first motion-picture projector 3*a* throughout the entire period of the game. With the reflective side of said rotatable mirror 12 facing said first motion-picture projector 3*a*, the first film P on said projector 3*a* is projected onto said screen 4. However, when the scene of first film P has reached a predetermined point, the light beam from said light source 11 passes through said aperture of the first film to form a glaring-light target on the screen 4. The mechanism for driving said second motion-picture projector is such that a drive means 16 for rotating said rotatable mirror 12 and an electromagnetic clutch 17 interposed between said second motion-picture projector 3*b* and said electric motor 14 are actuated by hit indicating signals Sx, Sy from said control circuit 9. Thus, upon the player's successful firing of his weapon 1, the first film P on said first motion-picture projector 3*a* is not illuminated from the illuminating light and said second film Q on said second motion-picture projector P is illuminated. Since, at the same time, said second motion-picture projector 3*b* is driven, the image scene on said second film Q, in lieu of the scene of first film P, is projected onto said screen 4.

In case the player 2 has failed to fire his weapon 1 at the target within said effective shooting time and, accordingly, said hit indicating signal Sy is absent from said control circuit 9, the electromagnetic clutch 17 alone is actuated at the end of said effective shooting time to drive the second motion-picture projector 3*b* and thereby to advance said second film Q to the next scene without causing said second film Q to be illuminated and projected onto said screen 4.

Figure 13:
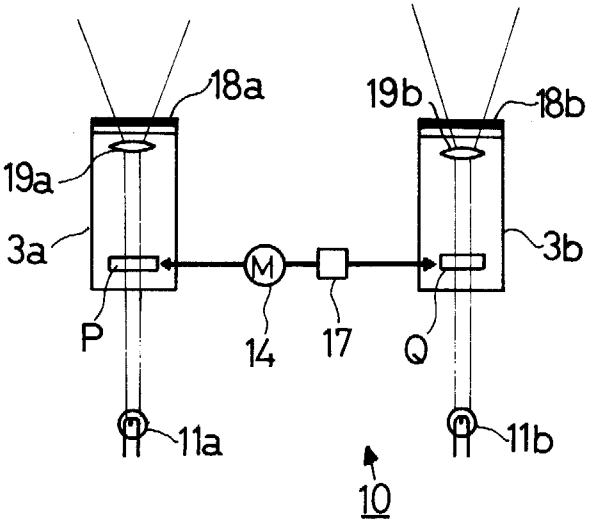
FIG. 13 is a schematic view of another projection-changeover device.

FIG. 13 shows another projection-changeover mechanism 10 embodying the principles of this invention which includes shutters 18*a* and 18*b* disposed in front of said first and second motion-picture projectors 3*a* and 3*b*, respectively. Normally, the first motion-picture projector 3*a* is driven with said shutter 18*a* being held in the open position with respect to the optical axis of said projector 3*a* and said shutter 3*b* in the closed position with respect to the optical axis of second motion-picture projector 3*b*. Upon generation of hit indicating signals Sx, Sy, the shutter 18*b* is opened and the shutter 18*a* is closed, while the second motion-picture projector 3*b* is driven to project said second film Q onto said screen 4.

Figure 14:
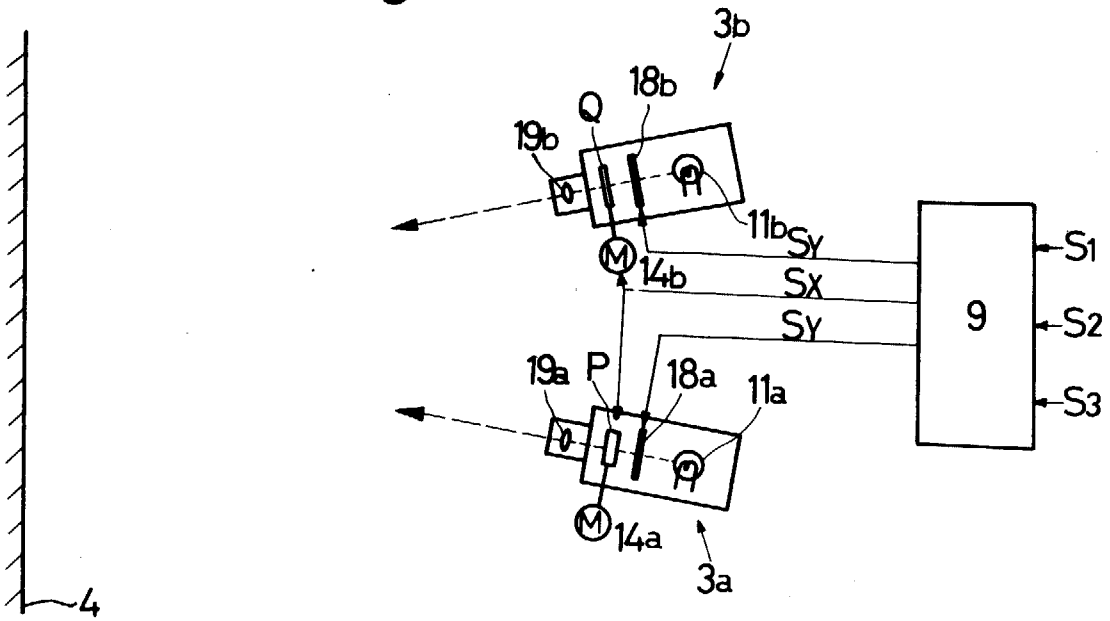
FIG. 14 is a schematic view showing still another projection-changeover device.
Figure 15:
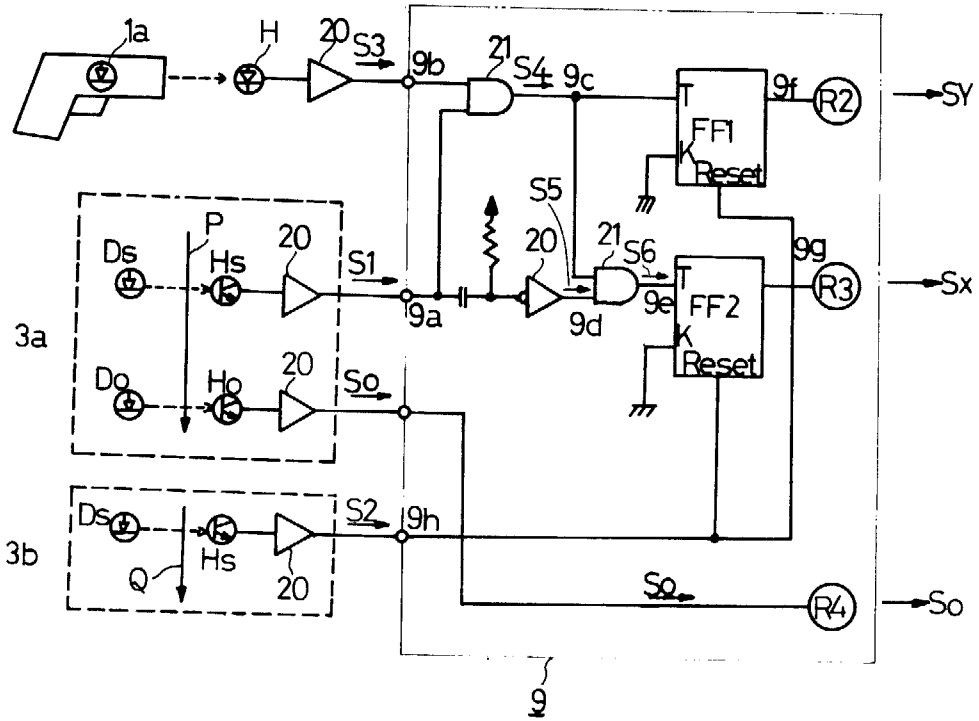
FIG. 15 is a circuit diagram showing the projection-changeover control circuit.
Figure 16:
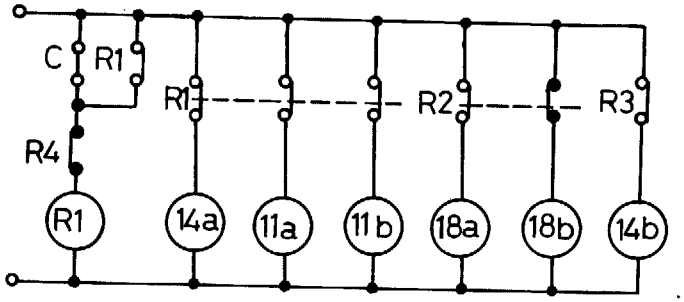
FIG. 16 is a diagram showing a relay circuit in said control circuit.

At the end of said effective shooting time, signal Sx alone is generated, with the result that the shutter 18*b* is closed and the second film Q on projector 3*b* is caused to advance to the starting point of the next scene without being projected onto screen 4. In the aforementioned control circuit 9, which is shown in FIGS. 15 and 16, reference symbol 1*a* is a light-emission diode built into the gun 1, H is a photo-transistor of said target 8, 20 is an amplifier, 21 is an AND circuit, $FF_1$ is a first flip-flop, $FF_2$ is a second flip-flop, $R_1$, $R_2$ . . . are relays, and C is a coin selector. For said motion-picture projectors 3*a* and 3*b*, there are provided light sources 11*a*, 11*b*, electric motors 14*a*, 14*b* and shutters 18*a*, 18*b* FIG. 14, respectively. Thus, 11*a* is a first lamp for said first motion-picture projector 3*a*, 11*b* is a lamp for said second motion-picture projector, 18*a* is a first shutter, 18*b* is a second shutter, 14*a* is a first electric motor and 14*b* is a second electric motor.

In the alternative arrangements of FIGS. 12 and 13, the single electric motor is started upon insertion of a coin into said coin selector and is allowed to run throughout the entire period of the game. The magnetic clutch 17 is actuated by a signal Sx for starting the second electric motor 14*b* of FIG. 13. The mirror-driving mechanism 16 may be driven by a signal Sy for actuating the second shutter 18*b* of FIG. 12.

Figure 17:
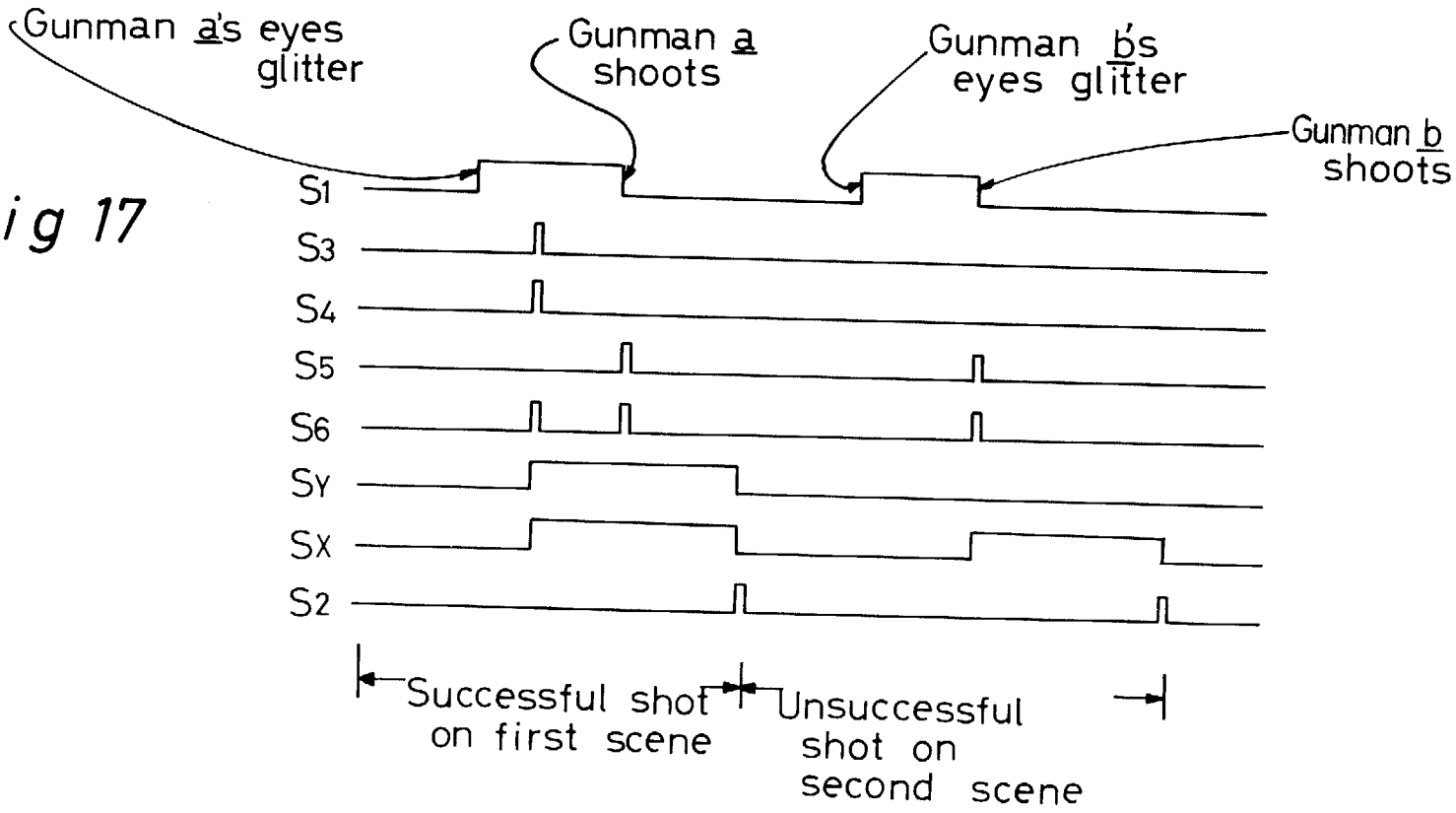
FIG. 17 is a diagram showing the signal waveforms at various points of said control circuit.

Referring, now, to FIG. 17, an effective shooting signal $S_1$ is generated at 9*a* of FIG. 15 during the period from the starting of said first motion-picture projector 3*a* to the time when the gunman on the screen fires his weapon. If the player fires his weapon exactly at the image of gunman (target area E') on the screen within this predetermined effective shooting time, a signal $S_3$ is generated at 9*b*. The signal $S_1$ and signal $S_3$ are fed to an AND circuit 21, whereby a signal $S_4$ is generated at 9*d*. The signals $S_4$ and $S_5$, generated at 9*c* and 9*d*, are fed to an AND circuit 21', whereby a signal $S_6$ is generated at 9*e*. The flip-flops $FF_1$ and $FF_2$ are thus reversed to excite relays $R_2$ and $R_3$. The excitation of relays $R_2$ and $R_3$ generates signals Sy and Sx, respectively. The signal Sy closes the shutter 18*a* for said first motion-picture projector 3*a* [The first projector is thus brought into non-projecting relation with said screen 4] and opens the shutter 18*b* for said second motion-picture projector 3*b* [The second projector is thus brought into projecting relation with said screen 4]. And signal Sy drives the motor 14*b* for the second motion-picture projector 3*b* (in the embodiment illustrated in FIGS. 14) and the image on said screen 4 is now replaced by the image from the second film Q showing the gunman wounded [the second motion-picture projector is driven to project said second film Q and the first motion-picture projector remains to be driven but the first film P thereon is not projected onto the screen 4]. Next, upon completion of the first scene of film Q on said second motion-picture projector 3*b*, the signal $S_2$ of second film Q is generated at 9*h* of FIG. 15 and the flip-flops $FF_1$ and $FF_2$ are reset to the original positions [The first film P on first motion-picture projector 3*a* starts being projected while the second motion-picture projector is stopped]. If the player fails to hit the target, no hit signal $S_4$ is generated at 9*c*. At 9*d*, a signal $S_5$ is generated at the end of the effective shooting time signal $S_1$ for said first motion-picture projector 3*a* [on the screen 4, when the gunman fires his weapon]. The second flip-flop $FF_2$ alone is reversed, with the result that the signal Sx alone is generated, with the signal Sy being not generated. Thus, with the shutter 18*b* for said motion-picture projector 3*b* remaining closed, the motor 14*b* for the second motion-picture projector 3*b* is driven to advance the film Q on said projector to the starting point of the next scene without being projected, whereby the scene projected by said first motion-picture projector 3*a* is matched with the scene projected by said second motion-picture projector 3*b* [The second projector 3*b* is driven but the second film Q thereon is not projected]. At the end of the entire game, a game-over signal $S_o$ is generated at 9*a* (FIG. 15), whereby the relay $R_4$ is acturated to reset the coin selector and, thereby, return the mechanism to standby position. The shooting game will hereinafter be explained.

At the start of the game, the lamp 11*a* of the first motion-picture projector 3*a* goes on and the first shutter 18*a* for said projector is opened. The electric motor is also driven. A signal direction for the start of advance of the first film A is transmitted from the control circuit, whereby the image from said first film P is projected on the screen 4.

In the meantime, at the start of the game, the lamp 11*b* of the second motion-picture projector 3*b* goes on but the second shutter 18*b* for the same projector remains closed, the second film Q being not advanced. During the advance of first film P on the first motion-picture projector 3*a* and after the gunman's eyes start glittering until shooting takes place, an effective shooting signal $S_1$ is transmitted from the first motion-picture projector 3*a* to the control circuit 9. If, during the generation of said effective shooting signal $S_1$ (the effective shooting time for the player), the player hits at the scene on the screen with his pistol, the light-sensitive element 8 on the reverse side of the screen 4 receives the light from the gun and transmits a hit signal $S_3$ to the control circuit 9. These two signals $S_1$ and $S_3$ are AND'ed in control circuit 9, whereby signals Sx and Sy are generated. The signals Sx and Sy are transmitted to the first motion-picture projector 3*a* and the second motion-picture projector 3*b* is started and the second shutter 18*b* is opened (the second motion-picture projector 3*b* is brought into projecting relation). Thus, the image on the second film Q on the second motion-picture projector 3*b* is projected onto the screen 4 (the second motion-picture projection ON). At the same time, the first shutter A for the first motion-picture projector 3*a* is closed (the first motion-picture projection OFF). The second motion-picture projector 3*b*, the second film (Q) on which has been started to advance by the impingement of a ray shot from the player's weapon, is stopped by film signal $S_2$ from the signal mark $K_2$ of second film Q and, at the same time, the second shutter 18*b* for the second motion-picture projector 3*b* is closed (the second motion-picture projector stops), while the first shutter 18*a* for the first motion-picture projector is opened (the first motion-picture projection ON).

Figure 18:
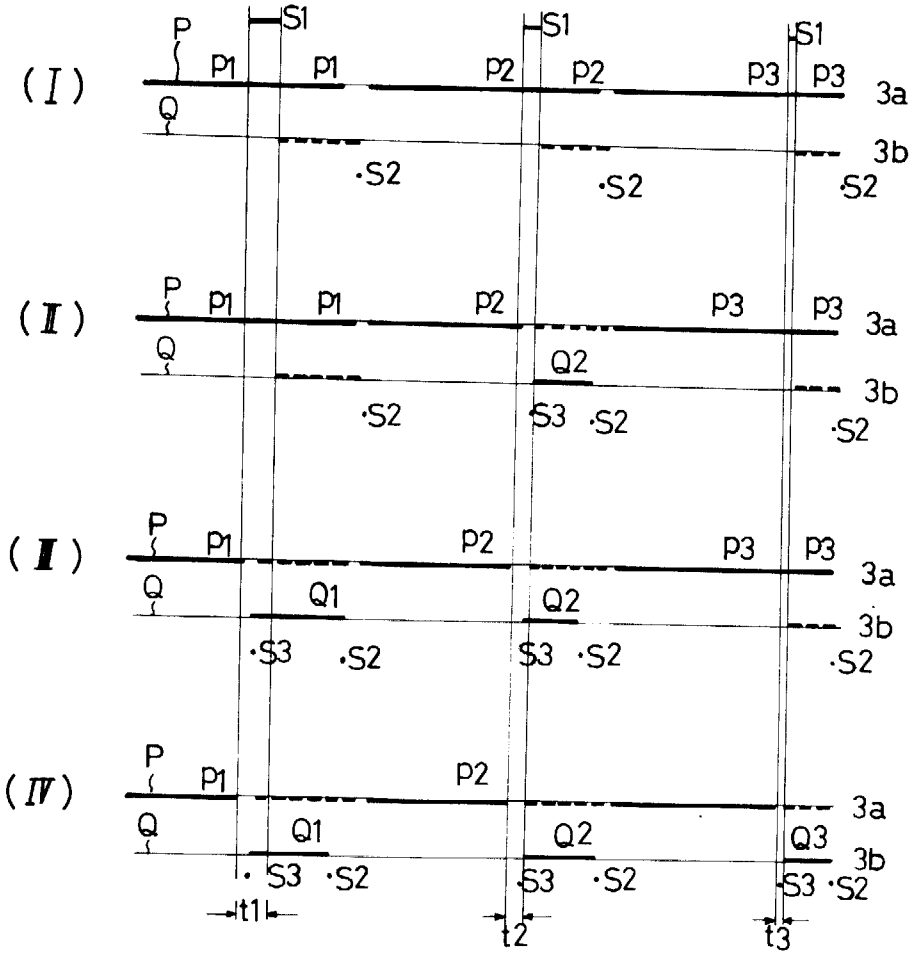
FIG. 18 is a schematic diagram showing the manner in which the scenes projected on the screen are changed.

FIG. 18 shows the afore-described operations with reference to various modes of shooting. I designates the case in which the first motion-picture projector 3*a* alone has functioned throughout, with the second motion-picture projector 3*b* being started after a predetermined time *t* but not project the second film Q (the second motion-picture projection OFF). II and III indicate the cases in which, during the game, one or two of the player's shots hit the targets, and V indicates that all of the shots hit the targets. Referring to FIG. 18, the solid line indicates that the image is actually projected on the screen, while the broken line indicates that although the film is advanced, the shutter remains closed and, therefore, no image is projected on the screen.

In connection with the above switchover of projection, the starting point of the second motion-picture projector 3*b* is altered by the difference in the timing of a hit (FIG. 18). Thus, since the first film A on the first motion-picture projector 3*a* keeps advancing during the time periods of $t_1$, $t_2$, $t_3$ . . . , there would be a discontinuity between the scenes from the two films. To avoid this discontinuity, a 'view-obstructive' display device (a white mass of smoke) R is provided at the leading end of each scene of second film Q (FIG. 7) so that despite the motion of the gunman during the shooting time *t*, the scenes $P_1$, $P_2$, $P_3$ . . . can be taken over by scenes Q, $Q_2$, $Q_3$ without giving an impression of discontinuity.

The objects to be shot in scenes $P_1$, $P_2$, $P_3$ . . . may be airplanes, cars or birds, in which case said white smokes may be replaced by clouds, houses and other objects.

In the control circuit described hereinbefore, the effective shooting period is defined by film signals but the same object can be accomplished by counting the frames (about 2000 to 3000 frames in all) of the first film P on the first motion-picture projector 3*a* from the game start by means of a counter, causing the counter to generate an effective shooting signal $S_1$, AND'ing this effective counting signal $S_1$ and a hit signal $S_3$ from the photo-transistor of the light-sensitive target and controlling all the operations including the starting of the second motion-picture projector 3*b* and the driving of the first shutter 18*a* of the first motion-picture projector 3*a* by means of the output signal of the AND-circuit.

I claim as my invention:

1. In a rapid firing game machine including a shooting system having a screen means, a weapon and a shooting detection means having a target area on said screen, a first motion picture projector for projecting an image showing an object to be shot at onto said screen, and a second picture projector for projecting an image showing said object in a defeated condition upon successful firing of said weapon at said object, the improvement comprising, in combination, employing a light-emitting gun as said weapon and at least one photo-sensor element which emits a signal when struck by light as said shooting detection means, the area on the screen, which when struck by light from said weapon will activate said photo-sensor, being the target area at least including a life-size image of each object to be shot as projected onto said screen, a single first film mounted on said projector having a plurality of scenes including at least a corresponding number of objects to be shot at, the first portion of each of said scenes showing the object in the scene to be shot at in a challenging position and a next portion thereof showing the same object in a triumphant position, a single second film mounted on said second projector having the same number of scenes showing the respective objects in defeated condition in the sequence corresponding to the sequence of appearance of said objects on said first film, said second film having a view-blocking image in an initial part of each scene and having a changeover mark at the boundary between adjacent scenes, detecting means in said second projector for detecting said changeover mark, shooting effective signal generating means in said first projector for generating from said first projector a signal to indicate when a portion of the scene corresponding to a time during which shooting will be effective for each of the scenes is displayed by said first film on said first projector, projector driving means coupled to said projectors for driving said first projector throughout the operation of the machine and for driving said second projector, control circuit means having inputs coupled to said shooting effective signal generating means, said sensor element, and said detecting means and having outputs coupled to said projector driving means for driving said second projector in the intervals in which a signal is received from said photo-sensor element and a shooting effective signal is received at the same time from said shooting effective signal generating means or when said shooting effective signal has disappeared without generation of a signal from said photo-sensor element, and for stopping said second projector when a changeover mark on said second film has been detected by said detecting means, and means coupled to said control circuit means for effectively directing the light projected from the second projector onto the screen only when a signal is received from said photo-sensor element and a shooting effective signal is simultaneously received from said shooting effective signal generating means and for continuing to direct the light from the second motion picture projector onto the screen until a changeover mark is detected, and for effectively directing the light from the first motion picture projector onto the screen when light from the second motion picture projector is not directed onto the screen.

2. The improvement as claimed in claim 1 in which said first film is an endless film and has a game-over signal mark thereon for generating a game-over signal at the end of the last of the series of scenes, and a game-over detecting means in said first projector and coupled to said control means for stopping said first projector when a game-over signal is generated.

3. The improvement as claimed in claim 1 in which a shooting starting indicator is provided on said film for projection on the screen in the initial portion of each of the effective shooting times and the position of the shooting starting indication is changed from one scene to another within the area of the image of the object to be shot at on said screen.

4. The improvement as claimed in claim 1 in which said first film has a signal mark thereon for actuating said shooting effective signal generating means for generating a shooting effective signal for a predetermined effective shooting time for each scene.

5. The improvement as claimed in claim 4 in which said shooting effective signal generating means includes means for making the length of the shooting time shorter in each succeeding scene.

* * * * *